US006680564B2

(12) United States Patent
Tomii

(10) Patent No.: US 6,680,564 B2
(45) Date of Patent: Jan. 20, 2004

(54) FIELD EMISSION TYPE COLD CATHODE STRUCTURE AND ELECTRON GUN USING THE COLD CATHODE

(75) Inventor: Kaoru Tomii, Kanagawa-Ken (JP)

(73) Assignee: LG Electronics Inc., Seoul (KR)

( * ) Notice: Subject to any disclaimer, the term of this patent is extended or adjusted under 35 U.S.C. 154(b) by 314 days.

(21) Appl. No.: 09/812,692

(22) Filed: Mar. 21, 2001

(65) Prior Publication Data

US 2001/0024082 A1 Sep. 27, 2001

(30) Foreign Application Priority Data

Mar. 22, 2000 (JP) ..... 2000-084731

(51) Int. Cl.[7] ..... H01J 29/46; H01J 1/05; H01J 1/02

(52) U.S. Cl. ..... 313/446; 313/309; 313/351

(58) Field of Search ..... 313/446, 309, 313/351, 311, 251; 445/4, 24, 23

(56) References Cited

U.S. PATENT DOCUMENTS 4,163,918 A * 8/1979 Shelton ..... 313/351
5,315,207 A * 5/1994 Hoeberechts et al. ..... 313/446
5,401,676 A * 3/1995 Lee ..... 313/311
5,496,199 A * 3/1996 Makishima et al. ..... 445/4
5,514,847 A * 5/1996 Makishima et al. ..... 313/308
5,543,680 A * 8/1996 Tomihari ..... 313/331
5,578,900 A * 11/1996 Peng et al. ..... 313/495
5,633,561 A 5/1997 Baker ..... 313/497
5,763,987 A * 6/1998 Morikawa et al. ..... 313/309
5,877,594 A * 3/1999 Miyano et al. ..... 313/497
5,929,557 A * 7/1999 Makishima et al. ..... 313/309
5,965,977 A * 10/1999 Makishima ..... 331/309
5,969,467 A * 10/1999 Matsuno ..... 313/309
6,018,215 A * 1/2000 Takemura ..... 313/309
6,283,812 B1 * 9/2001 Jin et al. ..... 445/24

FOREIGN PATENT DOCUMENTS

EP 0604939 A2 7/1994
JP 080111167 4/1996

* cited by examiner

*Primary Examiner*—P. Austin Bradley
*Assistant Examiner*—Briggitte R. Hammond
(74) *Attorney, Agent, or Firm*—Fleshner & Kim, LLP

(57) ABSTRACT

A field emission type cold cathode structure and an electron gun using the cathode are provided. The electron gun is capable of preventing electron emission error due to impurities etc. The electron gun includes a fusible metal layer formed between a base electrode and each emitter chip, a focus electrode formed on the upper portion of a gate electrode with an insulating layer therebetween, and a control electrode formed on the upper portion of a focus electrode with an insulating layer therebetween. The electron gun so constructed can reduce power for heating the cathode, display data and a picture instantly on a screen, simplify a structure of an electron lens etc. focusing an electron beam, and improving precision in electron gun assembly.

7 Claims, 7 Drawing Sheets

FIELD EMISSION TYPE COLD CATHODE STRUCTURE AND ELECTRON GUN USING THE COLD CATHODE

BACKGROUND OF THE INVENTION

1. Field of the Invention

The present invention relates to a field emission type cold cathode structure (spindt type cathode structure) and an electron gun having the cathode, in particular to a field emission type cold cathode structure and an electron gun using the cold cathode which is capable of preventing electron emission error due to impurities etc. infiltrated into the cathode part.

2. Description of the Prior Art

FIG. 1 illustrates a structure of a standard CRT (Cathode Ray Tube) in accordance with the prior art.

As depicted in FIG. 1, the standard CRT (Cathode Ray Tube) comprises a glass container 1, an electron gun 2, an electron beam 3, a deflection yoke 4, and a fluorescent screen 5, and it will now be described as below.

First, the electron gun 2 is installed at the end of the vacuum glass container 1, the electron beam 3 generated from the electron gun 2 is deviated by the deflection yoke 4 generating a magnetic field, and the electron beam is emitted to the fluorescent screen 5, accordingly the fluorescent screen 5 emits by being excited by the collision with the electron beam 3.

And, when the described CRT (Cathode Ray Tube) is actually used, a certain image can be displayed by controlling the quantity of the electron beam in accordance with an input image signal, deviating the electron beam 3 two-dimensionally, and scanning it on the fluorescent screen 5.

FIG. 2 illustrates a structure of a cathode used in an electron gun of a CRT in accordance with the prior art.

As depicted in FIG. 2, it comprises a nickel cylinder 6, an emitter 7, a heater 8, and a steatite disk 9. It will now be described.

First, the emitter 7 is installed at the front end of the nickel cylinder 6, herein an oxide cathode constructed with Ba, Ca, Sr etc. is widely used.

In addition, a cathode of high electric current density fabricated by impregnating an emitter into a porous tungsten can be used also.

In addition, the heater 8 is installed inside of the nickel cylinder 6, the electron beam is emitted from the emitter 7 to the vacuum. The cathode is mounted on the steatite disk 9 in order to make the assembly of the electron gun easier.

FIG. 3 illustrates a structure of a section of the electron gun used in the CRT in accordance with the prior art.

As depicted in FIG. 3, it comprises a first control electrode 10, a second control electrode 11, a third control electrode 12, a fourth control electrode 13, a free focus electron lens 14, a main electron lens 15, and a crossover of an electron beam 16, it will now be described as below.

First, the first control electrode 10 and second control electrode 11 for controlling the electron beam are installed on the front of the emitter 7 installed on the cathode.

In addition, the third control electrode 12 and fourth control electrode 13 are placed in order to form the main electron lens 15 for making the electron beam 3 into a detailed spot beam on the fluorescent screen 5.

In addition, the free focus electron lens 14 of the electron beam 3 is formed by the second control electrode 11 and third control electrode 12.

Direction dependency of the electron beam density emitted from the cathode, namely, electric current density j(θ) emitted from a normal line to a θ direction about current density j(A/m$^2$ steradian) vertical direction to the fluorescent screen, can be described as below Equation 1.

$$j(\theta)=j\cos\theta$$

Herein, the j describes the current density vertical to the fluorescent screen.

In addition, the emitted electron is discharged with a certain statistical initial velocity distribution, 'distribution of mark cell' about the velocity distribution of gas molecules can be adapted to a temperature corresponding to a temperature of the cathode.

As described above, in order to focus the electron emitted from each point of the cathode on one point of the fluorescent screen, various structures are provided for a control electrode for forming the main electron lens 15 and a control electrode for guiding the electron beam to the main electron lens.

FIG. 4 illustrates a field emission type cold cathode structure in accordance with the prior art.

As depicted in FIG. 4, it comprises a substrate glass 101, a base electrode 102, an insulating layer 103, a gate electrode 104, an emitter chip, e.g. emitter tip, 105, and an electron beam 106, a power 107. It can be described as below.

First, the emitter chip 105 constructed with a very small electric conductor (for example, molybdenum) having a cone shape is formed on the base electrode 102 formed on the substrate glass 101.

The gate electrode 104 constructed with an electric conductor (for example, nickel) is formed on the front end of the emitter chip 105 so as to surround the emitter chip 105.

And, the insulating layer 103 (for example, $sio_2$) is placed between the base electrode 102 and electrode 104 in order to insulate them.

As described above, when a certain voltage Vg is applied from the power 107 between the base electrode 102 and gate electrode 104, very strong field occurs on the front end of the emitter chip 105, and electron (electron beam 106) is emitted from the front end of the emitter chip 105.

When the electron is emitted from the front end of the emitter chip 105, the electron beam current as about 350 $\mu$A per 1 spot is required on the fluorescent screen, it is impossible to get the required electron beam current on the fluorescent screen with the one emitter chip 105.

Accordingly, in order to get the required electron beam current, the cathode is constructed by forming the plurality of emitter chips 105 on the two dimensional plane.

FIG. 5 illustrates a section of a field emission type cathode structure including the plurality of emitter chips in accordance with the prior art, herein a reference numeral 51 describes impurities.

As depicted in FIG. 5, when the impurities having the conductivity are stuck to the emitter chip 105 by a certain cause, the base electrode 102 and gate electrode 104 are in short circuit states.

When the base electrode 102 and gate electrode 104 are in the short circuit states, at this time high current flows between the base electrode 102 and gate electrode 104 through the emitter chip 105 and impurities 51. According to this, the voltage can not be applied between the emitter chip 105 and gate electrode 104, therefore the electron is not emitted from the other emitter chip 105.

In the prior art, there is the number of parts increase problem in the control electrode structure.

In addition, in the structure of the cathode in accordance with the prior art, because the electron is emitted by a heating method, although a main power of a television set is ON, a picture having good picture quality is not displayed on the CRT of the television set until the temperature of Ba reaches to the electron emission temperature.

In addition, in the CRT used for the general television, the required electron beam current is about 350 $\mu$A per one spot of the fluorescent screen, however the power for heating the cathode is required about 2 W, accordingly the electron emission efficiency is low.

In addition, in the prior art, when Ba as the electron emission material is used for a long time, it evaporates slowly by being heated, accordingly the electron emission efficiency deteriorates slowly.

In addition, in the prior art, because the electron emitted from the cathode surface is radiated from each point to each region and the initial velocity is irregular, in order to get the detailed electron beam spot on the fluorescent screen, the lots of control electrodes are required.

In addition, in the prior art, when the electron is emitted from the front end of the emitter chip 105, because the electron beam current as about 350 $\mu$A per one spot on the fluorescent screen is required, it is impossible to get the required electron beam current on the fluorescent screen with the one emitter chip 105.

In addition, in the prior art, when the base electrode 102 and gate electrode 104 are in the short circuit states, at this time high current flows between the base electrode 102 and gate electrode 104 through the emitter chip 105 and impurities 51. According to this, the voltage is not applied between the emitter chip 105 and gate electrode 104, therefore the electron is not emitted from the other emitter chip 105.

SUMMARY OF THE INVENTION

Accordingly, the object of the present invention is to provide a field emission type cold cathode structure which is capable of preventing electron emission error due to impurities etc. by constructing a field emission type cold cathode structure emitting electron by the field without using a structure emitting electron by heating.

The other object of the present invention is to provide a field emission type cold cathode structure which is capable of expanding its life span semi-permanently, improving the electron emission efficiency, reducing power consumption, and simplifying its structure.

The another object of the present invention is to provide an electron gun using the field emission type cold cathode structure in accordance with the present invention.

In order to achieve the objects of the present invention, the field emission type cold cathode structure in accordance with the present invention having a plurality of emitter chips formed on a base electrode, a gate electrode formed on a circumference of the each emitter chip, an insulating layer placed between the base electrode and gate electrode in order to insulate them, a certain DC (Direct Current) voltage applied between the base electrode and gate electrode comprises a fusible metal layer formed between the base electrode and the each emitter chip.

In the field emission type cold cathode structure, a focus electrode is installed on the upper portion of the gate electrode with an insulating layer between them.

In the field emission type cold cathode structure, the focus electrode is installed on the upper portion of the gate electrode with the insulating layer between them, and a control electrode is installed on the upper portion of the focus electrode with an insulating layer between them.

In addition, the field emission type cold cathode structure having the plurality of emitter chips formed on the base electrode with a certain interval, the gate electrode formed on a circumference of the each emitter chip, the insulating layer between the base electrode and gate electrode comprises gate electrodes formed on a circumference of the each emitter chip, main electrodes installed on the outer circumference surrounding the gate electrodes, and fusible metal layers formed between the main electrodes and gate electrodes.

In the field emission type cold cathode structure, a certain voltage is applied between the base electrode and main electrode.

In addition, in the electron gun using the field emission type cold cathode structure having a cathode part, a main electron lens, a first and a second focus electrodes, the cathode part comprises a plurality of emitter chips formed on the base electrode with a certain interval, a gate electrode formed on a circumference of the each emitter chip, a fusible metal layer formed between the base electrode and each emitter chip, a focus electrode formed on the upper portion of the gate electrode through the insulating layer, and a first and second focus electrodes formed on the front of the control electrode.

In the electron gun using the field emission type cold cathode structure, the base electrode and gate electrode are insulated each other through the insulating layer.

In the electron gun using the field emission type cold cathode structure, the electron beam emitted from the plurality of emitter chips is focused on the main electron lens formed by the first and second focus electrodes without forming crossover.

DETAILED DESCRIPTION OF THE PREFERRED EMBODIMENT

Figure 6:
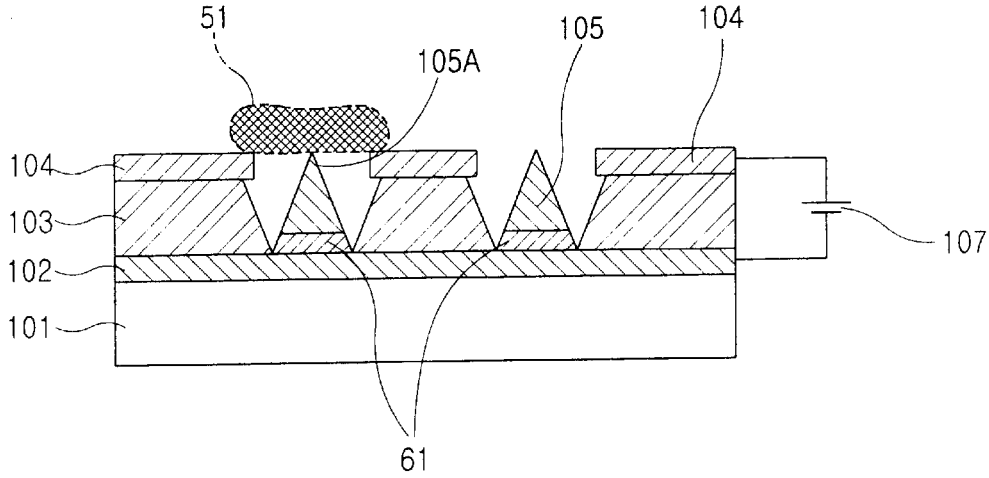
FIG. 6 describes a field emission type cold cathode structure in accordance with the present invention.

FIG. 6 describes a field emission type cold cathode structure (spindt type cathode structure) in accordance with the present invention, it further comprises a fusible metal layer 61.

Figure 4:
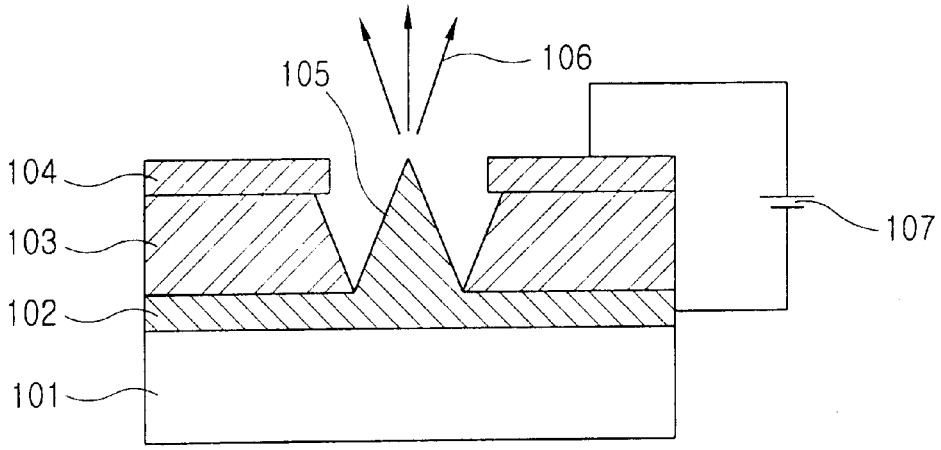
FIG. 4 CONVENTIONAL ART
FIG. 4 describes a field emission type cathode structure in accordance with the prior art.
Figure 5:
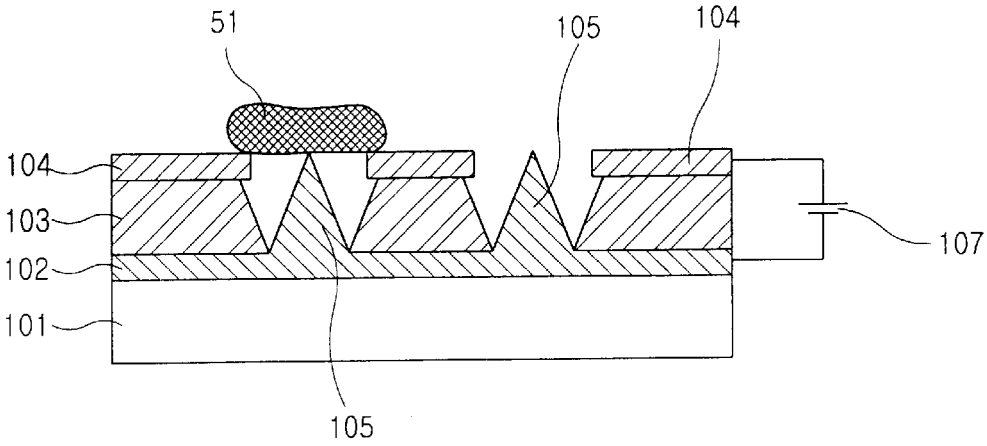
FIG. 5 CONVENTIONAL ART
FIG. 5 describes a section of a field emission type cathode structure comprising a plurality of emitter chips in accordance with the prior art.

Hereinafter, parts same with FIGS. 4 and 5 will have the same reference numerals, and FIGS. 6~10 will now be described in detail.

As depicted in FIGS. 6~10, a fusible metal layer 61 is formed between the emitter chip 105 and base electrode 104.

In addition, the present invention is not limited by the fusible metal, it is also possible to use a material fused by high current, for example, a semi conductor material.

For example, when the emitter chip 105A and gate electrode 104 are short-circuited by the conductive impurities 51 stuck to the emitter chip 105A and high current flows between the base electrode 102 and gate electrode 104 through the emitter chip 105A and impurity 51, an interval between the emitter chip 105 and gate electrode 104 can be open due to evaporation of the fusible metal layer 61.

Accordingly, although the emitter chip 105A and gate electrode 104 are short-circuited by the impurity 51, because the interval between the emitter chip 105 and gate electrode 104 is open instantly, a certain voltage can be applied between the other emitter chip 105 and gate electrode 104.

Figure 7A:
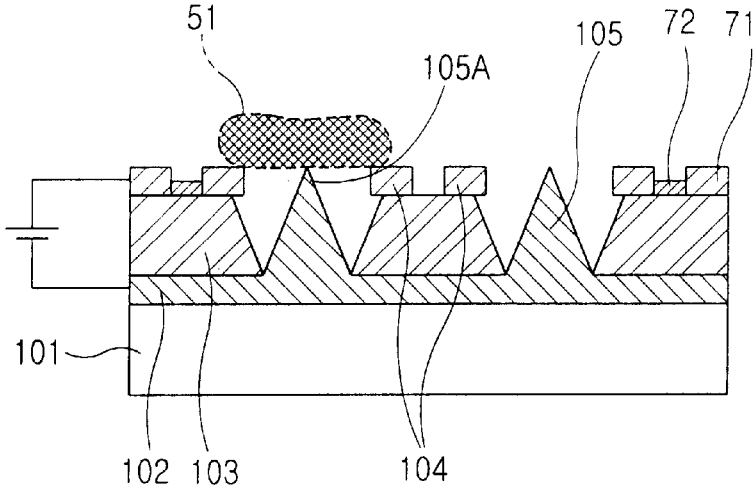
FIG. 7A describes a section of a cold cathode structure in accordance with the embodiment of the present invention.
Figure 7B:
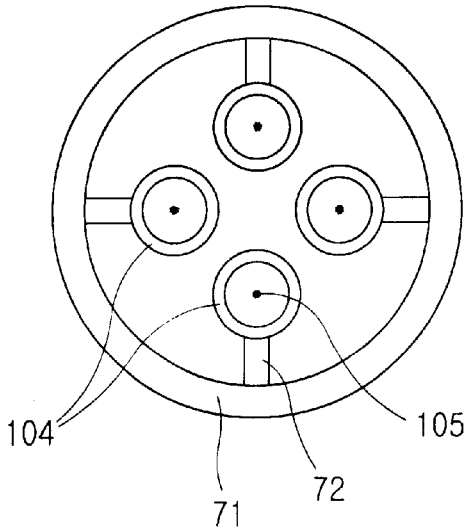
FIG. 7B is a plan view describing a cold cathode structure in accordance with the other embodiment of the present invention.

FIGS. 7A and 7B describes cold cathode structures in accordance with the different embodiments, FIG. 7A is a cross-sectional view of a cold cathode structure, and FIG. 7B is a plan view of a cold cathode structure. Herein, the reference numeral 71 describes main electrode, and the reference numeral 72 describes the fusible metal layer.

As depicted in FIGS. 7A and 7B, each separated gate electrode 104 is formed on the each emitter chip 105, the each gate electrode 104 contacts to the main electrode 71 by the fusible metal layer 72.

In addition, in the cold cathode structure, the four emitter chips 105, gate electrode 104 surrounding the four emitter chips, and main electrode 71 enclosing the four emitter chips 105 and gate electrode 104 are formed.

In addition, the emitter chips and gate electrodes can be formed as the number possible to contact with the surrounding main electrode 71.

In the cold cathode structure, as depicted in FIG. 6, for example, when the short-circuit state occurs between the emitter chip 105A and gate electrode 104 by the impurity 51, the high current flows from the emitter chip 15A flows to the interval between the base electrode 102 and main electrode through the gate electrode 104, the fusible metal layer 72 corresponding to the gate electrode 104 evaporates, accordingly the interval between the emitter chip 105A and gate electrode is open.

Accordingly, it is possible to apply the normal voltage between the other emitter chip 105 and gate electrode.

And, when the above-described cold cathode is used for a CRT (Cathode Ray Tube), it is possible to get a detailed electron beam spot on the fluorescent screen, and display a picture or characters having high picture quality by controlling the direction of the electron emitted from the each emitter chip 105 of the cold cathode with a control electrode and a focus electrode.

Figure 8:
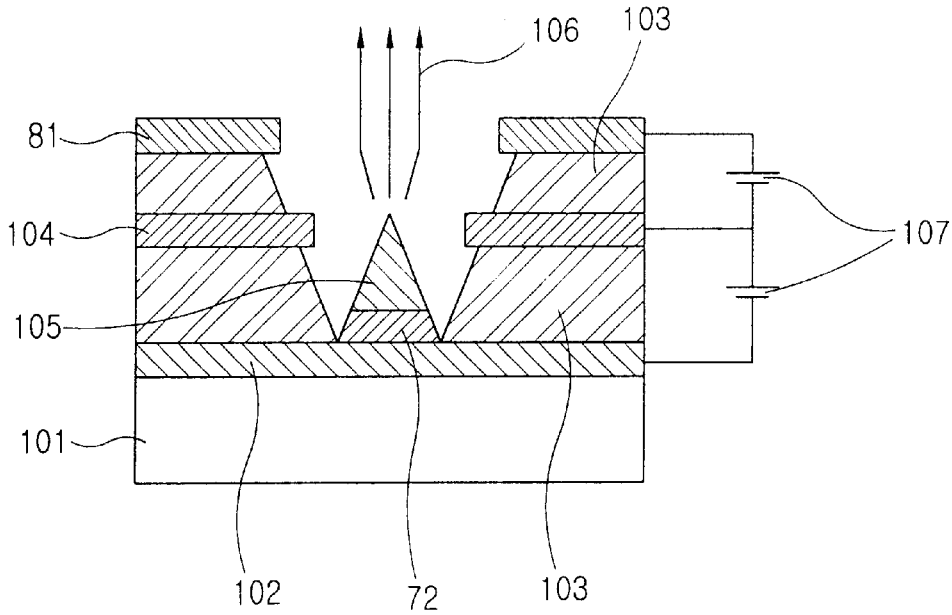
FIG. 8 describes a cold cathode structure in accordance with the another embodiment of the present invention.

FIG. 8 describes a cold cathode structure in accordance with the another embodiment of the present invention. The reference numeral 81 describes the focus electrode.

As depicted in FIG. 8, the focus electrode 81 is installed on the each emitter chip 105 through the insulating layer 103 on the gate electrode 104 in order to focus the electrode beam 106 emitted from the emitter chip 105.

In the embodiment, the fusible metal layer 72 is placed between the emitter chip 105 and base electrode 102 as well as FIG. 6.

Figure 9A:
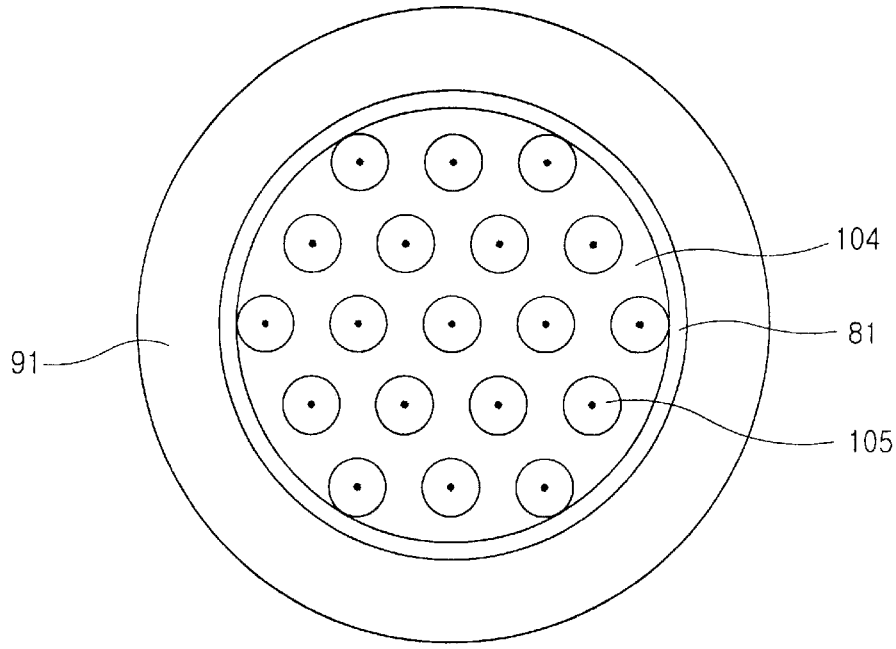
FIG. 9A is a plan view illustrating a cold cathode structure in accordance with the another embodiment of the present invention.
Figure 9B:
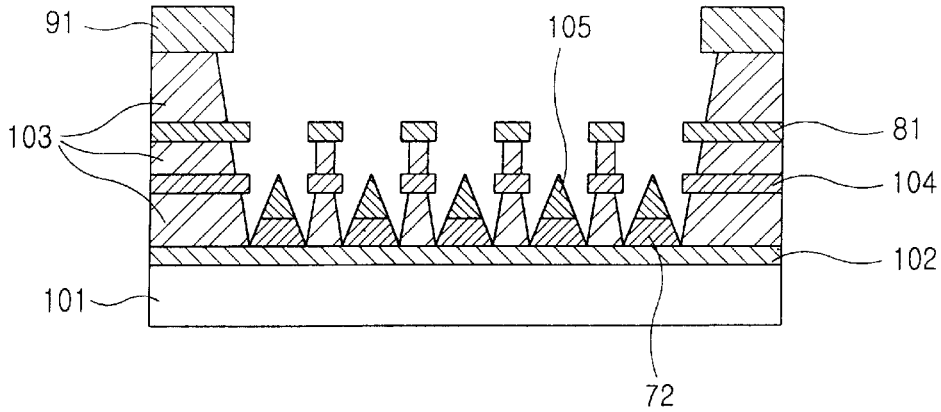
FIG. 9B is a cross-sectional view illustrating a cold cathode structure in accordance with the another embodiment of the present invention.

FIGS. 9A and 9B describes the cold cathode structure in accordance with another embodiment of the present invention, FIG. 9A is a plan view illustrating a cold cathode structure, and FIG. 9B is a cross-sectional view illustrating a cold cathode structure. Herein, the reference numeral 91 describes the control electrode.

As depicted in FIGS. 9A and 9B, the plurality of emitter chips 105 are placed on the two-dimensional plane and the focus electrode 81 is installed as well as FIG. 8, and the control electrode 91 is formed on the upper portion of the focus electrode 81 with the insulating layer 103 between them.

Figure 10:
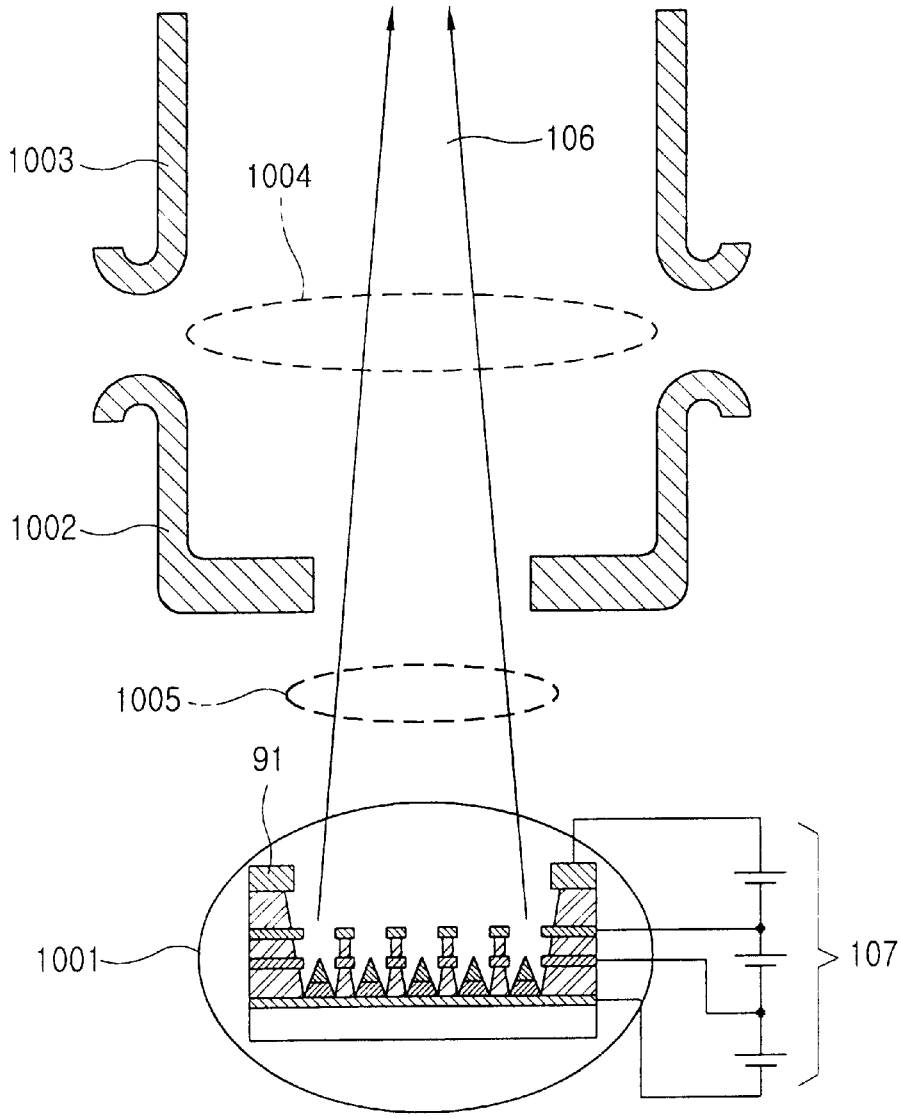
FIG. 10 describes a section structure of an electron gun using the cold cathode of FIGS. 9A~9B.

As depicted in FIG. 10, the control electrode 91 is for preventing the electron emission characteristic of the emitter chip 105 from being influenced by the field of the other electrode.

FIG. 10 describes a section structure of an electron gun using the cold cathode of FIGS. 9A~9B.

As depicted in FIG. 10, in a cathode part 1001 corresponding to the cold cathode structure of FIG. 9, a first focus electrode 1002 and a second focus electrode 1003 for forming a main electron lens 1004 are placed (formed) on the front of the control electrode 91 with a certain interval.

And, the electron beam 106 from the cathode part 1001 is focused in order to get the detailed electron beam on the fluorescent screen by the focus operation of the main electron lens 1004.

In addition, the free focus electron lens 1005 is formed between the control electrode 91 and first focus electrode 1002 in order to make an incidence angle of the electron beam incidence on the main electron lens 1004 smaller, and make focus of the electron beam spot on the fluorescent screen smaller.

In addition, in the present invention, the main electron lens 1004 for contacting to the electron beam without forming a crossover (Refer to reference numeral 16 of FIG. 3) of the electron beam on the front of the cold cathode can be formed.

Meanwhile, in the electron gun using the field emission type cold cathode structure in accordance with the present invention, because the cathode part can be formed by using a photolithography technology, position of three cathode parts (each cathode for RGB (Red, Green, Blue)) used for the present color CRT (Cathode Ray Tube) can be determined very accurately, accordingly a manufacturing process such as a purity adjustment, a convergence adjustment etc. can be reduced.

Figure 1:
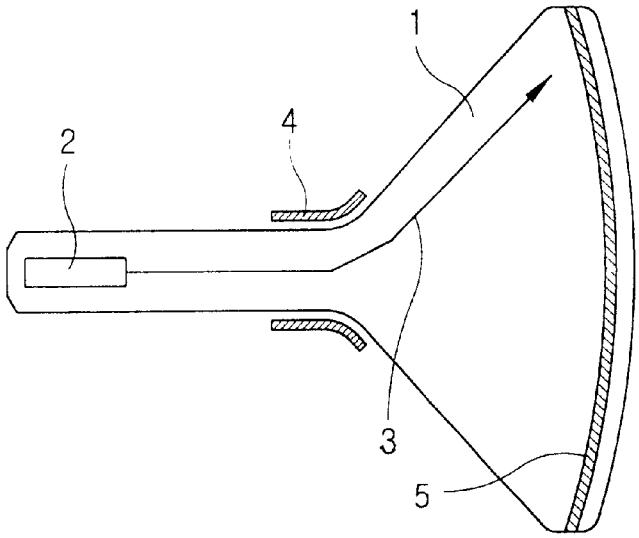
FIG. 1 CONVENTIONAL ART
FIG. 1 describes a structure of a standard CRT (Cathode Ray Tube) in accordance with the prior art.
Figure 2:
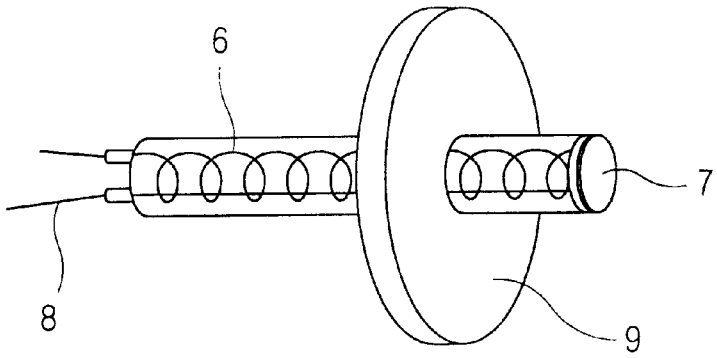
FIG. 2 CONVENTIONAL ART
FIG. 2 describes a structure of a cathode used for an electron gun of the CRT in accordance with the prior art.
Figure 3:
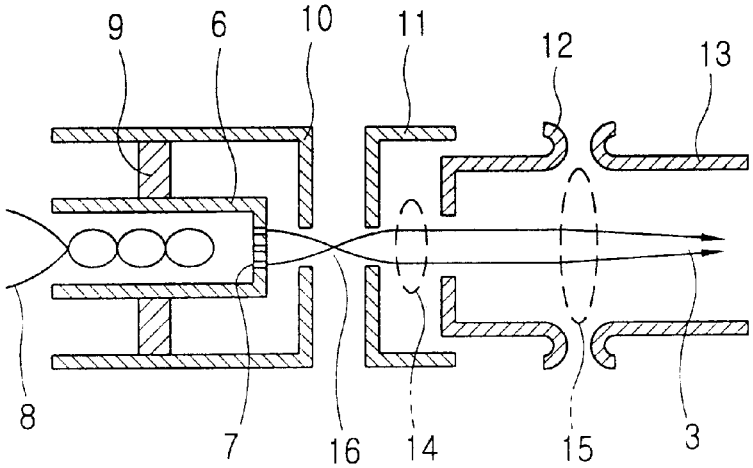
FIG. 3 CONVENTIONAL ART
FIG. 3 describes a section structure of an electron gun used for the CRT in accordance with the prior art.

In addition, in comparison with the structure of FIG. 3 in accordance with the prior art, the first control electrode 10 and second control electrode 11 are unnecessary in the field emission type cold cathode structure in accordance with the present invention, accordingly the overall structure can be simplified.

As described above, because the electron emission in the present invention is not by the heater heating but by the field, the present invention can reduce the power for heating the cold cathode, and can display data and picture instantly on a screen. Accordingly, it is possible to reduce the standby time for displaying the picture.

In addition, in forming of the cold cathode structure having good electron emission characteristic, the present invention can simplify the structure of the electron lens etc. focusing the electron beam, and can get the detailed electron beam spot on the fluorescent screen.

In addition, when the present invention is adapted to the color CRT, because the cold cathode in accordance with the present invention can be formed on a same substrate at the same time with the photolithography technology, three cold cathodes having very accurate position can be formed, and the assembly precision of the electron gun can be improved.

What is claimed is:

1. A field emission type cold cathode structure having a plurality of emitter tips on a base electrode with a certain interval therebetween, a gate electrode formed at a circumference of the each emitter tip and an insulating layer formed between the base electrode and gate electrode, the structure comprising:

a fusible metal layer formed between the base electrode and each emitter chip tip;

a first insulating layer formed on the gate electrode, wherein the gate electrode is formed at a circumference of each emitter tip;

a first cathode electrode formed on the first insulating layer;

a second insulating layer formed on the first cathode electrode;

a cathode control electrode formed on the second insulating layer; and second and third cathode electrodes formed at a front of the cathode control electrode.

2. A field emission type cold cathode structure having a plurality of emitter tips on a base electrode with a certain interval therebetween, a plurality of gate electrodes, each formed at a circumference of each of the emitter tips, and an insulating layer formed between the base electrode and the gate electrodes, comprising main electrodes installed on the insulation layer at an outer circumference and surrounding the plurality of gate electrodes; and fusible metal layers formed on the insulation layer between the main electrodes and the gate electrodes.

3. The field emission type cold cathode structure according to claim 2, wherein a certain voltage is applied between the base electrode and main electrodes.

4. An electron gun using a field emission type cold cathode structure having a cathode part, a main electron lens, and first and second focus electrodes, wherein the cathode part comprises:

a plurality of emitter tips formed on a base electrode with a certain interval therebetween;

a gate electrode formed at a circumference of each emitter tip;

a fusible metal layer formed between the base electrode and each emitter tip;

a focus electrode formed on the upper portion of the gate electrode with an insulating layer between them;

a control electrode formed on the upper portion of the focus electrode with insulating layer between them; and second and third focus electrodes formed at a front of the control electrode.

5. The electron gun using the field emission type cold cathode structure according to claim 4, wherein the base electrode and gate electrode are insulated through the insulating layer.

6. The electron gun using the field emission type cold cathode structure according to claim 4, wherein the electron beams emitted from the plurality of emitter tips are focused on a main electron lens formed by the second and third focus electrodes without forming a crossover.

7. The electron gun using the field emission type cold cathode structure according to claim 4, wherein the cathode part is separately formed in accordance with each Red R), Green (G) and Blue (B) colors.

* * * * *